US005587201A

United States Patent [19]

Rho et al.

[11] Patent Number: 5,587,201

[45] Date of Patent: Dec. 24, 1996

[54] FILMING COMPOSITION FOR CATHODE RAY TUBE AND METHOD OF MANUFACTURING SCREEN USING THE SAME

[75] Inventors: Hwan-chul Rho; Hong-gyu Choi; Jae-myung Kim, all of Hwaseong-gun, Rep. of Korea

[73] Assignee: Samsung Display Devices Co., Ltd., Kyungki-do, Rep. of Korea

[21] Appl. No.: 413,888

[22] Filed: Mar. 30, 1995

[30] Foreign Application Priority Data

Dec. 7, 1994 [KR] Rep. of Korea ..... 94-33112

[51] Int. Cl.[6] ..... B05D 5/06

[52] U.S. Cl. ..... 427/64; 427/68; 427/226; 427/227; 427/389.7; 427/407.2; 427/419.1

[58] Field of Search ..... 427/64, 68, 389.7, 427/419.1, 407.2, 226, 227; 524/284, 434, 436

[56] References Cited

U.S. PATENT DOCUMENTS

| | | | |
|---|---|---|---|
| 4,312,895 | 1/1982 | Yamazaki et al. | 427/64 |
| 4,917,978 | 4/1990 | Rih et al. | 427/68 |
| 5,198,487 | 3/1993 | Kissel | 523/403 |
| 5,336,080 | 8/1994 | Sumitomo et al. | 427/64 |
| 5,382,452 | 1/1995 | Bruno et al. | 427/64 |

*Primary Examiner*—Janyce Bell
*Attorney, Agent, or Firm*—Leydig, Voit & Mayer

[57] ABSTRACT

A method for manufacturing a screen having high luminance is provided including the steps of forming a phosphor layer on a black matrix adhered to a panel, forming a filming layer by coating and drying a filming composition containing a decomposable organic polymer and a reducing agent on the phosphor layer, forming a metal layer on the filming layer, and heating the phosphor layer, filming layer and metal layer to a temperature sufficient to decompose the filming layer.

5 Claims, 1 Drawing Sheet

FILMING COMPOSITION FOR CATHODE RAY TUBE AND METHOD OF MANUFACTURING SCREEN USING THE SAME

BACKGROUND OF THE INVENTION

The present invention relates to a filming composition for a cathode ray tube and a method for manufacturing a screen using the same, and more particularly, to a composition for forming a filming layer as an interlayer between a phosphor layer and a metal deposited layer, and a method for manufacturing a screen having enhanced luminance using the same.

In manufacturing the screen of a general cathode ray tube, a black matrix layer made of graphite is formed on the inner face of a panel and on the portion where pixel will not be formed. A phosphor layer for forming a pixel is formed on the black matrix layer using a photoresist formed by photolithography and a filming layer is formed as an interlayer on the phosphor layer by coating or spraying a filming composition. A metal layer is formed on the filming Layer by depositing metal.

Thereafter, the interlayer, i.e., the filming layer formed between the phosphor layer and the metal layer, is removed by heating to a high temperature. As the result, the metal layer is provided on the phosphor layer with a predetermined distance therebetween. The reason for forming the metal layer at a distance from the phosphor layer will be explained in detail, referring to the attached drawings.

When electrons emitted from an electron gun collide with the phosphor particles in the phosphor layer 3, the phosphor particles emit light in all directions, including both the front side and back side of the panel 1. At this time, the metal deposited layer S such as aluminum-deposited layer reflects the light emitted to the back side of the panel 1 to the front side to enhance the luminance at the front side of the screen. However, if the metal deposited layer 5 is formed directly on the phosphor layer 3, the metal is injected between the phosphor particles and a uniform and continuous layer cannot be obtained (FIG. 1). Therefore, the light radiates through the non-continuous point of the layer to reduce the reflection amount, and the luminance at the front side of the screen cannot be sufficiently enhanced.

To solve this problem, an organic layer (referred to as a filming layer 4) which can be decomposed by heating is formed on the phosphor layer 3 and a metal deposited layer 5 is formed on the filming layer (FIGS. 2 & 3). Subsequently, through removing the organic material by heating to a temperature at which the organic layer is decomposed, a flat and uniform metal layer spaced apart from the phosphor layer by a predetermined distance is manufactured.

Two methods, an aqueous system and an oily system, are used for manufacturing the filming layer between the phosphor layer and the metal layer. In the aqueous system, a filming composition comprising acryl emulsion as a main component is used. On the other hand, lacquer is used in the oily system (thus called a lacquer method).

In the aqueous system, the main components of the filming composition are polyvinyl alcohol and acryl emulsion. To these components can be added glycerine as a wetting agent and ammonium hydroxide and hydrogen peroxide to prevent swelling of the metal layer during baking. In the aqueous system, separate baking at a temperature of 400°~450° C. is needed after forming the metal layer in order to decompose and remove the organic materials in the phosphor layer and the filming layer. However, frit sealing at 400°~450° C. for sealing a panel and a funnel should be carried out afterward. As a result, the metal layer is baked twice.

Of course, the organic material may be decomposed and removed during the frit sealing process. However, in this case the following problems occur. The acryl emulsion, B74 (by Rohm & Haas), used as a main component in the conventional filming composition has a molecular weight of about 4 million and a decomposition starting temperature of 300° C. or higher. If the separate baking for decomposing the organic material is not carried out, since the decomposition of the organic material in the filming layer is delayed and organic gas remains even at temperatures of 400°~450° C., which is the softening and crystallizing point of the frit. The residual gas inhibits the frit sealing so that complete sealing is difficult. Even when sealing is done, since organic material remains due to the incomplete combustion or the residual gas remains in the cathode ray tube, the characteristics of the cathode ray tube such as lifetime and luminance are deteriorated. Accordingly, separate baking to decompose and remove the organic material cannot be omitted.

In the oily system (the lacquer method), a lacquer prepared by dissolving acryl resin in a solvent such as toluene, ethyl acetate, or methyl ethyl ketone is sprayed on the phosphor layer to obtain a filming layer. In this method, the surface tension of the organic solvent with water is utilized. That is, the organic material is dispersed to form a thin organic layer on the water layer. Accordingly, the filming layer is very flat while having a very small amount of organic material. Thus, a separate baking to remove the organic material can be advantageosly omitted. After forming the filming layer and the metal layer by depositing metal such as aluminum, the remaining small amount of organic material can be almost completely removed through the frit sealing.

However, in this method, since the organic solvent is volatile and explosive, separate equipment, such as a ventilation system and a closed room, is needed and the process is overly complicated, so the maintenance and management of the process is very difficult.

The aqueous system and the oily system, each having some advantages and disadvantages, both contain a common problem. That is, the metal layer, especially the aluminum layer formed on the filming layer, is oxidized by heat treatment which is performed at least once.

If the metal layer is oxidized, the light reflection ratio is abruptly reduced, and as the result, the intensity of the light toward the phosphor layer is reduced to deteriorate the luminance of the screen. Luminance is an important factor for determining the image quality of a cathode ray tube, and affects the design of the shadow mask and electron gun. Accordingly, it is considered essential to avoid such luminance deterioration.

SUMMARY OF THE INVENTION

An object of the present invention is to provide a filming composition containing a reducing agent for forming a a filming layer which is temporarily formed in the metal layer to prevent oxidation of the metal layer formed in the screen during heat treatment, even at high temperature.

Another object of the present invention is to provide a method for manufacturing a screen having enhanced luminance by preventing the oxidation of the metal layer by using the filming composition.

To accomplish the object, there is provided in the present invention a filming composition for a cathode ray tube for forming a filming layer as an interlayer to manufacture a metal layer of a screen for a cathode ray tube, wherein the filming composition further comprises a reducing agent.

The other object of the present invention is accomplished by a method for manufacturing a screen comprising the steps of forming a phosphor layer on a black matrix formed on a panel, forming a filming layer by coating and drying a filming composition containing a reducing agent on the phosphor layer and forming a metal layer on the filming layer.

Since the object of the present invention will be accomplished by using an agent having reducing power, any reducing agent may be included in the filming composition of the present invention. Especially, reducing agents having a strong reducing power are preferred. For example, $MgH_2$, alkali metal salts, zinc salts, tin salts, formic acid or some mixture thereof can be used.

The preferred amount of the reducing agent ranges from 1.0~5.0 wt % based on the total amount of the composition. If the amount is less that 1.0 wt %, the reducing power is too weak to obtain a good effect. If the amount exceeds 5.0 wt %, the increase of the effect according to the increase of the amount is somewhat reduced and the component of the reducing agent remains as a foreign material. Accordingly, the abovementioned range is preferred.

BRIEF DESCRIPTION OF THE DRAWINGS

The above objects and advantages of the present invention will become more apparent by describing in detail preferred embodiments thereof with reference to the attached drawings in which.

DETAILED DESCRIPTION OF THE INVENTION

Figure 1:
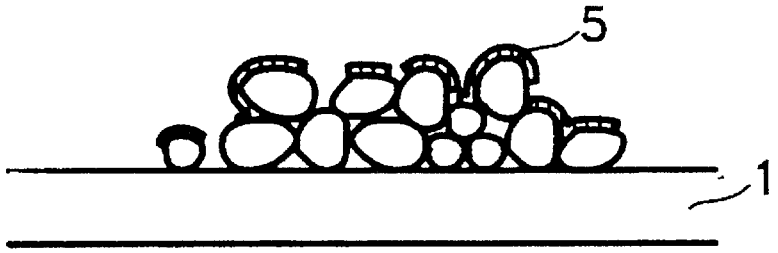
FIG. 1 is a cross-sectional view of a discontinuous metal reflection layer in a screen of a cathode ray tube.
Figure 2:
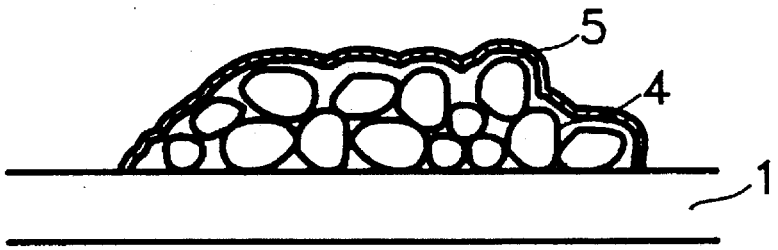
FIG. 2 is a cross-sectional view of a continuous metal reflection layer in a screen of a cathode ray tube.
Figure 3:
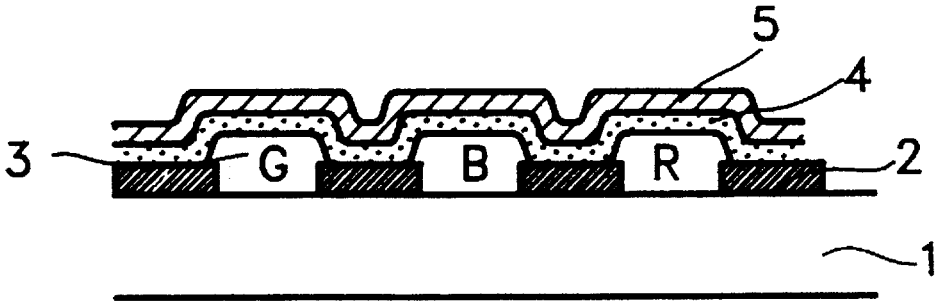
FIG. 3 is a cross-sectional view of a screen for a general cathode ray tube, to show the elements thereof.

According to the present invention, since a reducing agent is contained in the filming layer which is temporarily formed as a pre-treatment layer for forming a metal layer, oxidation of the metal layer is prevented even under heat-treatment at high temperature. Therefore, the deterioration of the light reflection efficiency due to the oxidation of the metal layer is reduced, and a screen having enhanced luminance can be obtained.

The composition of the present invention can be applied to both an aqueous system and an oily system.

The preferred embodiments of the present invention will be described in detail.

First, a black matrix layer is formed in the panel on a portion where a pixel will not be formed. On the portion where a pixel will be formed, a phosphor pattern is formed by spin-coating a phosphor slurry, exposing the coated phosphor layer to ultraviolet light through holes of a shadow mask, and developing the resultant layer using an aqueous alkaline solution. Here, the phosphor slurry is prepared by mixing phosphor, polymer cured through an ultraviolet photo-reaction, photoresist and water. The above coating of a phosphor slurry and the exposing and developing steps are repeated for each color phosphor to form each color phosphor pattern.

In the aqueous system, the filming composition is preferably comprised of 5~8wt % of acryl emulsion as a solid content as a main component, and pure water, hydrogen peroxide, polyvinyl alcohol and glycerine constitute the remaining portion. To this composition, 1~5wt % (based on the total amount of the filming composition) of a reducing agent, preferably a strong reducing agent such as $MgH_2$, calcium salt or zinc salt is added to form the filming composition according to the present invention. The preferred salts are nitrate, sulfate and chloride. The viscosity of the prepared composition is about 4~5cps. The filming composition is coated on the panel where the black matrix and each color phosphor pattern are formed to form a filming layer. It is preferred that a small amount of ammonium oxalate $(NH_4)_2C_2O_4.H_2O$ is sprayed on the filming layer to form small holes in the subsequently formed metal layer. This is for allowing the organic gas generated during the step of decomposing and removing the filming layer by baking, to be exhausted through the holes without swelling the metal layer. Aluminum is vacuum deposited on the filming layer to form a continuous and uniform aluminum metal layer. The organic material layer, i.e., the filming layer, is decomposed and removed by baking at about 400°~450° C. to form a screen according to the present invention.

In the oily system using lacquer, the filming composition includes 1~2 wt % of acryl emulsion (ELBASITE manufactured by DUPON) as a solid content. As organic solvent for the filming composition, MIBK (methyl isobutyl ketone), EAC (ethyl acetate) or toluene are used. The viscosity of the composition is about 4~5 cps. A reducing agent in the amount of 1~5 wt % based on the total amount of the filming composition (preferably a strong reducing agent such as $MgH_2$, calcium salt or zinc salt) is added in the same manner as in the aqueous system to obtain the filming composition according to the present invention. The prepared filming composition is coated on the panel where the phosphor pattern is formed, to form the filming layer. Aluminum is vacuum deposited on the filming layer to form a metal layer. According to the lacquer method, since the amount of the organic material in the filming layer is small, a separate baking operation is not needed. The organic layer is decomposed and removed by the heat applied during frit sealing.

As described above, in the screen manufactured by using the filming composition containing a reducing agent according to the present invention, the oxidation of the metal layer formed on the filming layer is prevented and the reflection ratio of the electron toward the screen is increased. Therefore, the luminance is enhanced when compared with a screen manufactured by using the conventional filming composition which does not contain the reducing agent. Pure aluminum is white while the aluminum oxide is black.

According to experimentation carried out by the present inventors, it was confirmed that the luminance of the screen was increased by about 10% when compared with the conventional screen.

Regarding the application field and the operation principle, the filming composition of the present invention can of course be applied to monochrome cathode ray tubes as well as color cathode ray tubes.

What is claimed is:

1. A method for manufacturing a screen having high luminance comprising the steps of:

forming a phosphor layer on a black matrix adhered to a panel;

forming a filming layer by coating and drying a filming composition containing a decomposable organic polymer and a reducing agent on said phosphor layer;

forming a metal layer on said filming layer; and heating said phosphor layer, filming layer and metal layer to a temperature sufficient to decompose said filming layer.

2. A method for manufacturing a screen as claimed in claim 1, wherein said reducing agent is at least one strong reducing agent selected from the group consisting of $MgH_2$, alkali metal salts, zinc salts, tin salts and formic acid.

3. A method for manufacturing a screen according to claim 2 wherein said salts are nitrate, sulfate or chloride.

4. A method for manufacturing a screen as claimed in claim 1, wherein the amount of said reducing agent is 1.0~5.0 wt % based on the total amount of said filming composition.

5. A method for manufacturing a screen according to claim 1 wherein said decomposable organic polymer includes an acryl resin.

* * * * *